United States Patent [19]

Koves

[11] Patent Number: 4,690,363

[45] Date of Patent: Sep. 1, 1987

[54] CANVAS CARRIER

[76] Inventor: Thomas Koves, 431 S. Burnside Ave., #2C, Los Angeles, Calif. 90036

[21] Appl. No.: 901,743

[22] Filed: Aug. 29, 1986

[51] Int. Cl.[4] ..... A47B 97/04

[52] U.S. Cl. ..... 248/449; 248/163.1; 248/454

[58] Field of Search ..... 248/449, 448, 454, 452, 248/453, 163.1, 431, 172, 440, 176, 460, 464, 167, 178; 40/606, 607, 611

[56] References Cited

U.S. PATENT DOCUMENTS

| | | | |
|---|---|---|---|
| 2,236,133 | 3/1941 | Croninger et al. | 248/449 X |
| 3,095,834 | 7/1963 | Killen | 248/449 X |
| 3,122,858 | 3/1964 | Kadin | 248/449 |
| 3,599,925 | 8/1971 | Dubler | 248/452 |
| 3,738,606 | 6/1973 | Millen | 248/449 |
| 3,969,838 | 7/1976 | Moore | 40/606 |
| 4,165,856 | 8/1979 | Wiseheart | 248/449 |
| 4,260,124 | 4/1981 | Heilman | 248/449 |
| 4,558,522 | 12/1985 | Lance | 248/449 X |
| 4,591,124 | 5/1986 | Hellenbrand et al. | 248/454 X |
| 4,610,414 | 9/1986 | Schuck | 248/449 |

*Primary Examiner*—Ramon O. Ramirez
*Attorney, Agent, or Firm*—Allan M. Shapiro

[57] ABSTRACT

Portable canvas carrier has a central spine with a carrying handle. Movably mounted on the central spine are cross members for holding one or more canvases. The cross members are adjustable for canvas size. A tripod head is attachable to the central spine and is clampable thereto at selected position. The tripod head is of sufficient adjustability to swing from a near horizontal to a near vertical position. The head is carried on three tripod legs for support of the canvas carrier and easel apparatus.

10 Claims, 6 Drawing Figures

FIG. 1.
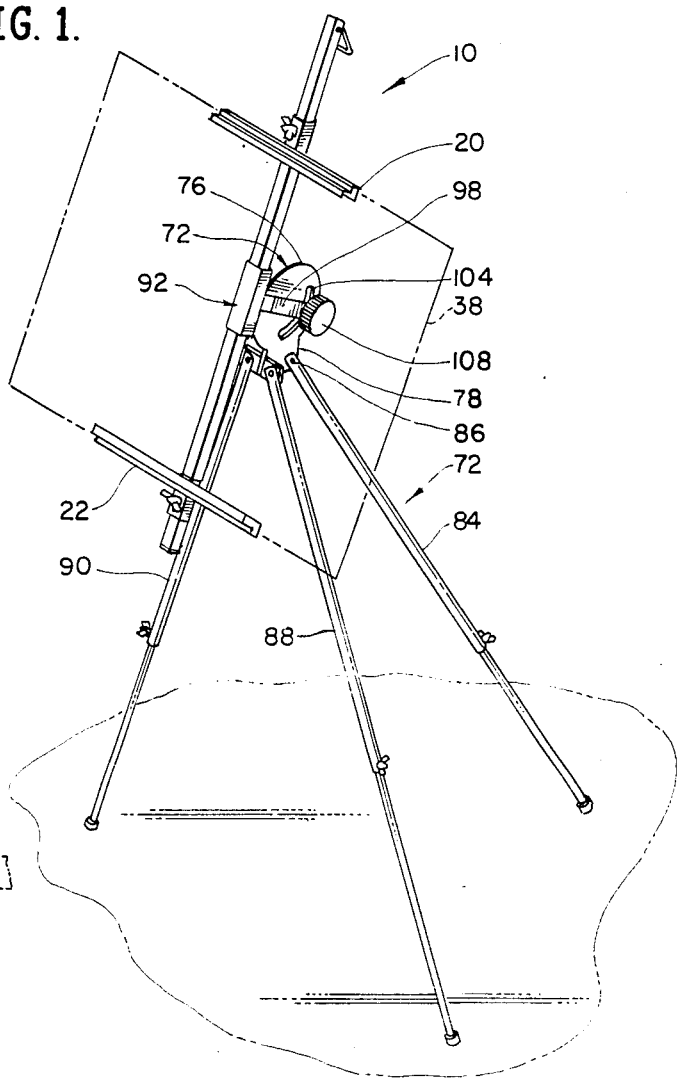
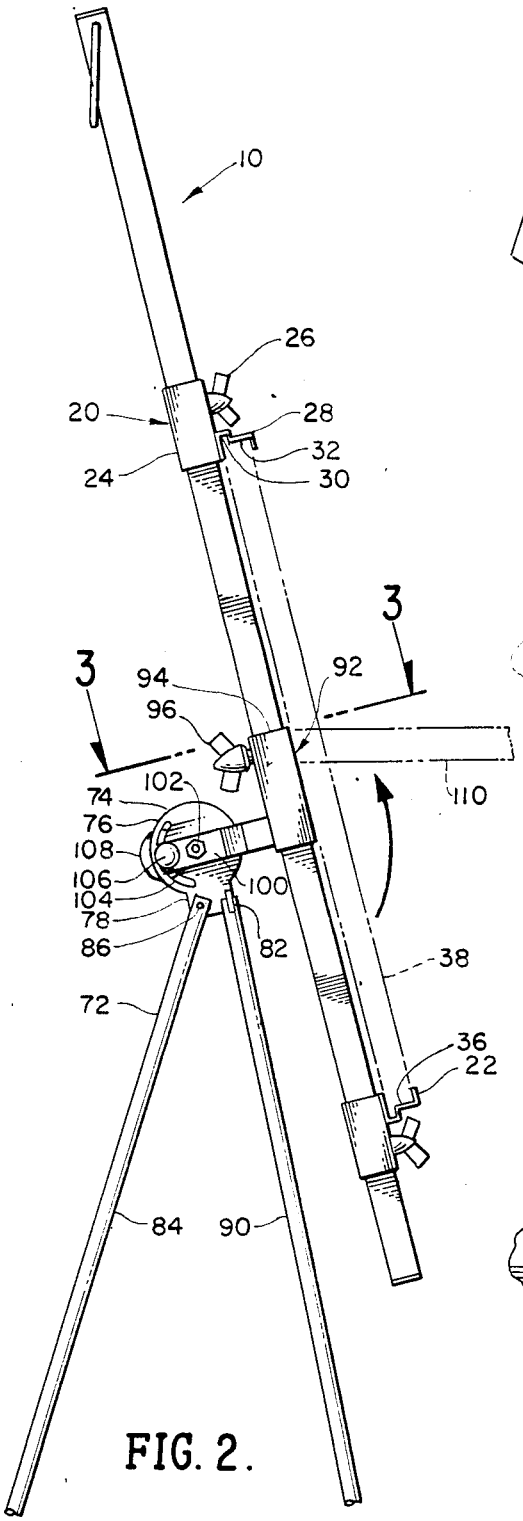
FIG. 2.
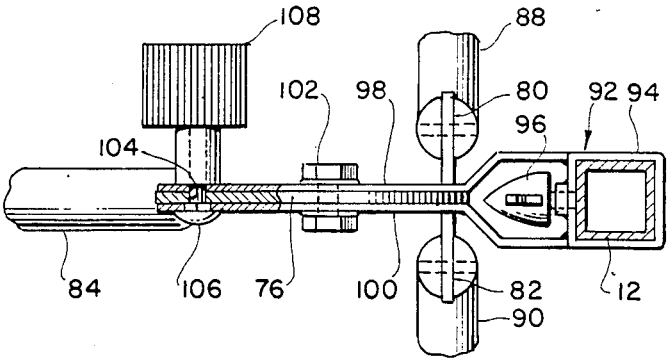
FIG. 3.

CANVAS CARRIER

BACKGROUND OF THE INVENTION

This invention is directed to a portable canvas carrier which can be used to carry a plurality of artists' canvases, of differing sizes, and then attached to the head of a tripod to form an easel apparatus, with the tripod pivotally carrying the canvas carrier.

There are many versions of artists' easels on the market which provide the artist with usage which has been restricted by the lack of adequate adjustability and versatility. The artist must select the canvas to conform to easel adjustability. Easels of limited adjustability allow use of only a few sizes of canvases and another easel must be selected to use a canvas of other size. The artist is also restricted to the few vertical angular positions that the easel will allow. In order to paint with water colors, which can tend to drip and run downwardly, the artist must use a near horizontal surface, which is a position the easel cannot reach. If the artist wishes to carry his work after completion, he must use a portfolio or other auxiliary means. If the artist wishes to work away from the studio and move from site to site, he must use easels which are awkward to transport and of limited versatility. Thus, there is need for a portable artists' canvas carrier and easel which is versatile as to height and angular position as well as the size of canvas it will accommodate so that it can be used to hold the canvas during painting and to transport both the artwork and the other canvases.

SUMMARY OF THE INVENTION

In order to aid in the understanding of this invention, it can be stated in essentially summary form that it is directed to a portable canvas carrier which can hold a plurality of canvases of different sizes and has an associated tripod on which it can be mounted for use as an easel. The canvas carrier comprises an elongated spine and two or more cross members which are slidably positionally adjustable along the spine and releaseably securable to the spine by means of manual fasteners. The tripod comprises a head to which are pivotally secured telescoping legs.

It is, thus, an object and advantage of this invention to provide a portable canvas carrier which can be used by itself to transport a plurality of artists' canvases from one location to another and then be mounted on a tripod for use as an easeel apparatus.

Another object and object of this invention is to provide canvas carrier with a plurality of cross members for accommodating a number of canvases of differing sizes.

A further object and advantage of this invention is to provide an easel apparatus with a canvas holder which is adjustable in vertical angle so as to present the canvas for work and to display the canvas at the angle desired by the artist, which angle can vary from horizontal to vertical so that the easel can be employed by an artist who is working in any medium including oil, watercolors, charcoal and so forth.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective view of a preferred embodiment of a portable canvas carrier and easel apparatus in accordance with the present invention.

FIG. 2 is an enlarged side elevational view of the apparatus of FIG. 1, with parts broken away.

FIG. 3 is a further enlarged top plan view, partially broken away and sectioned, taken along line 3—3 in FIG. 2.

DESCRIPTION OF THE PREFERRED EMBODIMENTS

Figure 4:
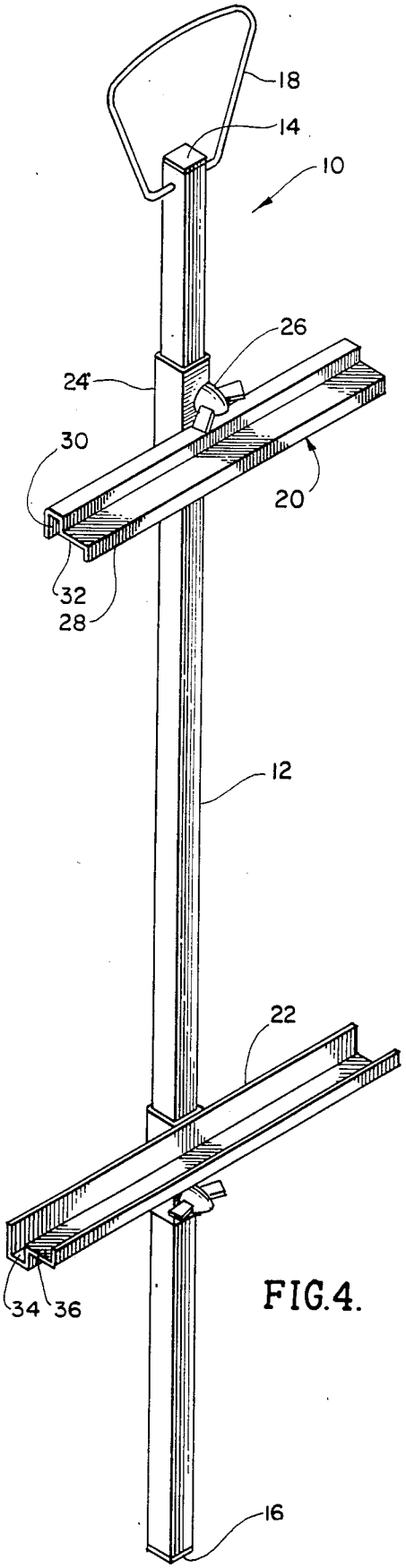
FIG. 4 is a perspective view of a first preferred embodiment of a canvas carrier in accordance with the present invention.

The first preferred embodiment of the canvas carrier is generally indicated at 10 in FIG. 4. The canvas carrier has a central spine 12 which is elongated and of light weight. Metallic tubular construction is preferable. Since it is desirable to support cross members thereon in a manner in which they do not rotate on the spine, the spine is preferably of non-round cross section. It may be circular with a key or keyway, but is preferably rectangular or square, as shown. Central spine 12 is a straight, square tube of uniform cross section. Top and bottom caps 14 and 16 close the central tubular opening. Bail handle 18 is in the form of a shaped wire which attaches to the central spine and the holes therein adjacent the top thereof. Bail handle 18 is sized to be grasped in the hand, and may have a cushion formed thereon.

Cross members 20 and 22 are identical. Cross member 20 includes collar 24, which is slightly larger than the exterior dimensions of spine 12 so as to be able to slide longitudinally thereon. Thumbscrew 26 is threaded through screwthreads in collar 24 so that the screw can be tightened against central spine 12 to lock the collar on the spine at the selected position. Rail 20 is of uniform cross section and is formed of sheet metal, or the like, to provide two channels 30 and 32 therein. These channels correspond to channels 34 and 36 in cross member 22. Perhaps they are better seen in the cross member 22. Some surfaces upon which an artist works are carried on relatively thin support in a direction normal to the surface, while other such surfaces are carried on relatively thick supports in a direction normal to the working surface. Examples of the first kind of material and support are a phenolic panel with surface material such as paper or cloth mounted thereon and a pad of watercolor papers. An example of the thicker kind of support is canvas stretched on a frame. The channels 30 and 34 are sized in the front-to-back direction, normal to the length of the channels and the direction of adjustability of the channels so that the smaller channels 30 and 34 receive the thinner materials, while the channels 32 and 36 receive the thicker materials. Both the members 20 and 22 are adjustable along the length of the spine so that they can be engaged upon the edge of a panel having the artist working surface. Such a panel is indicated in dashed lines at 38 in FIGS. 1 and 2.

It is seen in FIG. 2 that the panel is of the thicker dimension, such as canvas stretched on a frame, and occupies the wider channels 32 and 36. The adjustability of the cross members along the length of the spine permits the cross members to grasp panels of different width in the direction along the spine. When the artist working surface is clamped in this way, it can be conveniently transported by manual grasp of handle 18.

Figure 5:
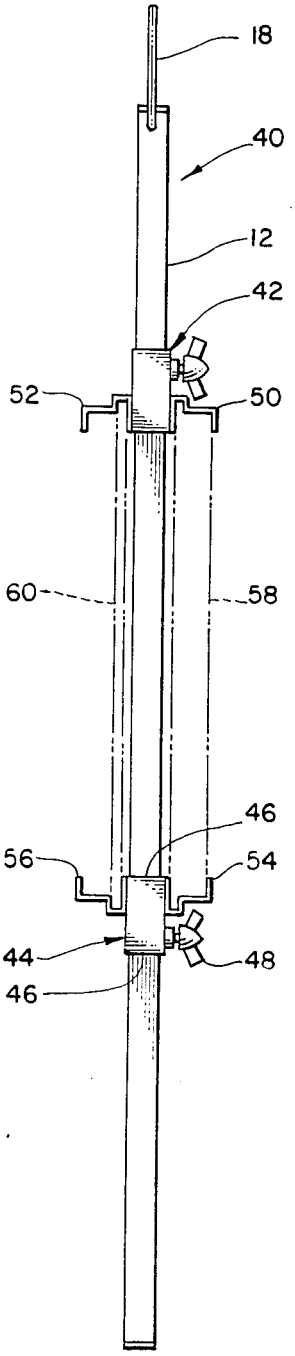
FIG. 5 is a side elevational view on reduced scale of a second preferred embodiment of a canvas carrier in accordance with the present invention.

Canvas carrier 40, shown in FIG. 5, has the same spine 12 with its handle 18. Canvas carrier 12 carries two identical cross members 42 and 44. The cross members each have a collar, with a collar 46 indicated on the lower cross member. Collar 46 carries thumbscrew 48 to tighten the collar at a selected position on spine 12. In this way, collar 46 is identical to collar 24. Rails 50 and 52 are respectively secured to the front and back of the collar of cross member 42, while rails 54 and 56 are respectively secured to the front and back of collar 46. The rails 50 through 56 are each identical to the rail 28 so that each rail can accept a thinner or a thicker panel. In this way, the canvas carrier 40 can carry a panel on both front and back, providing they are of the appropriate width to both be clamped at the same cross member position. A thicker panel 58 is shown in dashed lines as being engaged in the wide channels of rails 50 and 54, while a thinner panel 60 is shown as engaged in the narrower channels of rails 52 and 56. By means of this construction, both panels can be carried at the same time, providing they are of appropriate comparable widths. Furthermore, two thick panels of equal width or two thin panels of equal width could be carried at the same time.

Figure 6:
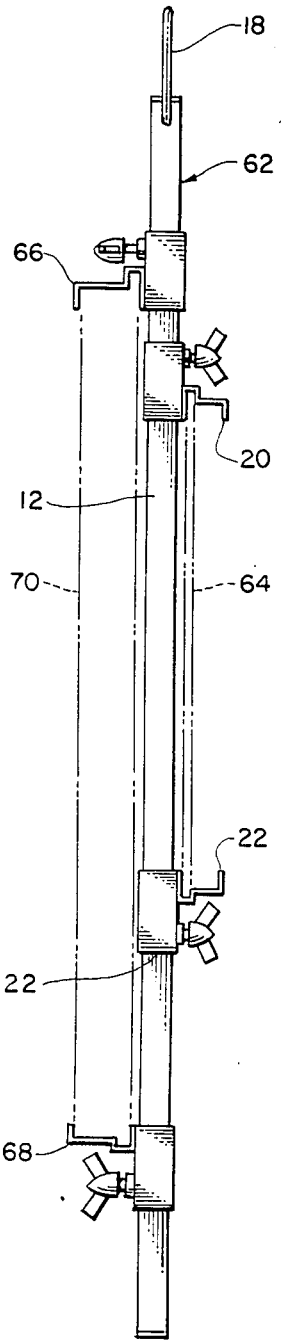
FIG. 6 is a side elevational view of a third preferred embodiment of a canvas carrier in accordance with the present invention.

Canvas carrier 62 is illustrated in side elevation in FIG. 6. It includes a central spine 12 with handle 18 which is identical to that structure described with respect to FIG. 4. Furthermore, it includes cross members 20 and 22 which are identical to those cross members identified in FIG. 4. Thus, the cross members 20 and 22 can be adjusted to clamp on and carry a panel of selected width, such as thin panel 64. In addition, central spine 12 carries cross members 66 and 68 which each include a cross rail, a collar and a thumbscrew. Furthermore, the cross members 66 and 68 are identical to the cross members 20 and 22, but are mounted upon the central spine 12 in a directly opposite position so that one panel can be carried on each side of the central spine. For example, thick panel 70 is engaged and clamped by cross members 66 and 68 on the opposite side of central spine 12 from thin panel 64. Since these cross members can be separately adjusted, they can carry panels of different widths. Two panels can thus be conveniently carried by means of the portable canvas carrier 62. Another assembly which may be useful in some circumstances would be to employ the cross merber 44 towards the lower end of the central spine with the cross members 20 and 66 adjacent the upper end of the central spine. With this construction, a difference in width between the two panels need not be as great to both be gripped by the opposing rails on the cross members.

In addition to acting as a means for supporting, carrying and storing artists' canvas and other panels, the canvas carriers illustrated in FIGS. 4, 5 and 6 can also be employed in association with a tripod to hold the canvas or other panels for work or for display. FIGS. 1 and 2 illustrate tripod 72 in association with canvas carrier 10. It can equally readily be employed with canvas carriers 40 or 62. Tripod head 74 includes disc 76 which has a lower tab 78 thereon. Flanges 80 and 82, see FIG. 3, are secured to the lower front of the tab and extend away from the tab at right angles thereto. Rear tripod leg 84 is bifurcated, engages around the lower back corner of tab 78, and is pinned thereto by means of pin 86, see FIG. 2. Pin 86 permits swinging of the rear tripod leg 84 in the plane of disc 76. Similarly, right and left tripod legs 88 and 90 are respectively pivotally mounted upon flanges 80 and 82. There is a built-in mechanical limit to the extent to which the tripod legs can be spread. FIGS. 1, 2 and 3 illustrate the maximum spread where the bifurcated leg engages with the tab or flange to limit the spread. Each of the tripod legs is provided with a telescoping section to provide height and level adjustments, as is seen in FIG. 1. Each of the telescoping lower leg sections can be locked with respect to the tripod legs in the retracted position and in a selected extended position, such as for example, the position shown in FIG. 1.

Tripod head 74 includes interconnecting control unit 92 which engages both the canvas carrier and the tripod head. Collar 94 is of such size as to slidably engage around the central spine 12 of the canvas carrier. It may be the same cross-sectional dimension as collar 24. Thumbscrew 96 locks collar 94 on spine 12 at the selected location. Arms 98 and 100 are secured to collar 94 and extend back across the disc 76. They are pivoted on bolt 102 which passes through both the arms and the disc to permit pivoting of the arms on the disc. At its rear, the disc 76 is provided with opening 104 past which the arms 98 and 100 extend. Clamp bolt 106 passes through openings in the rear ends of arms 98 and 100, through the arcuate opening 104, and is engaged by clamp nut 108. By tightening clamp nut 108, the arms are clamped against the disc to prevent rotation around the horizontal axis of pivot bolt 102 and, when released, permits angular adjustment of the canvas carrier with respect to the tripod head.

As shown in full lines in FIGS. 1 and 2, the canvas carrier can be swung to a fairly upright position where it is suitable for painting with oils or for display. The dashed line position indicated at 110 shows that the tripod permits swinging of the control unit to a point where it holds the canvas carrier in a horizontal position, sometimes used in painting, especially with watercolors. In addition to the angular adjustment of the control unit on the tripod head, the canvas carrier can be adjusted up and down, longitudinally the length of its own central spine 12 within collar 94 to adjust the height of the canvas with respect to the ground. This is helpful in both display and in painting. When the canvas carriers in FIGS. 5 and 6 are used in association with the tripod, it is clear that the back set of channels cannot be employed for the holding of canvas. However, those channels can be adjusted out of the way so that full utility of the tripod can also be enjoyed with those canvas carriers.

This invention has been described in its presently contemplated best mddes, and it is clear that it is susceptible to mumerous modifications, modes and embodiments within the ability of those skilled in the art and without the exercise of the inventive faculty. Accordingly, the scope of this invention is defined by the scope of the following claims.

What is claimed is:

1. In combination:

a central spine, said central spine having a substantially uniform exterior cross section;

a manually engageable handle on said central spine for manual grasp;

first and second cross members on said central spine, each of said first and second cross members being mounted on said central spine, each of said adjustable cross members having a collar thereon which embraces said spine, means on said collar for locking said collar at a selected position on said spine;

means on each of said first and second cross members for engagement on an artist's canvas panel so that said means on said cross member can grasp an artist's canvas panel to be carried by said manually graspable handle, each of said cross rails having first and second channels therein, said first channel having sufficient width to engage on the edge of a panel of first thickness and said second channel having a width suitable to engage on the edge of a panel of second thickness;

a tripod, said tripod having a head and having three legs pivotally mounted to said head, said tripod head having a transverse pivot axis, said tripod head being substantially upright disc with said axis substantially through the center of said disc, an arcuate slot through said disc around said axis, a control unit engaging said central spine and said tripod head, and a clamp engaging said control unit and extending through said arcuate slot to clamp said control unit at a selected angle with respect to said disc on said tripod head.

2. A portable carrier and easel apparatus comprising:

a tripod, legs on said tripod and a head on said tripod;

a canvas carrier, said canvas carrier having a central spine and having first and second cross members thereon, said cross members each having a cross rail thereon, at least one of said cross members being adjustable with respect to said central spine so that said cross rails can be adjusted towards and away from each other, said cross rails each having a channel thereon sized to engage over the edge of an artist panel, said cross rails facing each other so that a panel engaged thereby is retained thereby;

manual means on said central spine for manual grasp so that said central spine and cross members carried thereon may be manually engaged and carried; and a control unit interconnected said central spine and said tripod head for supporting said central spine, said control unit being slidably mounted on said central spine and a locking mechanism between said control unit and said central spine so that said central spine can be moved to a selected position on said control unit and locked at the selected position for adjustment of said central spine and said cross members thereon with respect to said tripod head.

3. A portable carrier and easel apparatus comprising:

a tripod, legs on said tripod and a head on said tripod;

a canvas carrier, said canvas carrier having a central spine and having first and second cross members thereon, said cross members each having a cross rail thereon, at least one of said cross members being adjustable with respect to said central spine so that said cross rails can be adjusted towards and away from each other, said cross rails each having a channel thereon sized to engage over the edge of an artist panel, said cross rails facing each other so that a panel engaged thereby is retained thereby;

manual means on said central spine for manual grasp so that said central spine and cross members carried thereon may be manually engaged and carried; and a control unit interconnecting said central spine and said tripod head for supporting said central spine, said control unit being pivoted on said tripod head on a transverse pivot pin engaged therebetween and an arcuate slot together with a clamp bolt through said arcuate slot so that said control unit can be angularly adjusted with respect to said tripod head and said clamp bolt can clamp said control unit to said tripod head in a selected angular position of said control unit and a selected position of said clamp bolt through said arcuate slot.

4. The portable canvas carrier and easel apparatus of claim 3 wherein said control unit is slidably mounted on said central spine and there is a locking mechanism between said control unit and said central spine so that said central spine can be moved to a selected position on said control unit and locked at the selected position for adjustment of said central spine and said cross members thereon with respect to said tripod head.

5. The portable canvas carrier and easel apparatus of claim 4 wherein both of said cross members are adjustable with respect to said central spine.

6. The portable canvas carrier and easel apparatus of claim 4 wherein said central spine is of substantially uniform exterior cross section and said control unit includes a collar which embraces said central spine, a clamp engaged between said collar of said control unit and said central spine so that said central spine can be clamped in said collar and said control unit at a selected position.

7. A portable carrier and easel apparatus comprising:

a tripod, legs on said tripod and a head on said tripod, said tripod head comprising a generally upright plate upon which three tripod legs are separately pivotally mounted, a pivot pin through said upright plate and through said control unit so that said control unit lies on one side of said upright plate, an arcuate slot and a clamp bolt through said arcuate slot, said upright plate and said control unit so that clamping in said clamp bolt clamps said control unit at a preselected angular position with respect to said upright plate;

a canvas carrier, said canvas carrier having a central spine and having first and second cross members thereon, said cross members each having a cross rail thereon, at least one of said cross members being adjustable with respect to said central spine so that said cross rails can be adjusted towards and away from each other, said cross rails each having a channel thereon sized to engage over the edge of an artist panel, said cross rails facing each other so that a panel engaged thereby is retained thereby;

manual means on said central spine for manual grasp so that said central spine and cross members carried thereon may be manually engaged and carried; and a control unit interconnecting said central spine and said tripod head for supporting said central spine.

8. The portable canvas carrier and easel apparatus of claim 7 wherein said upright plate is a disc and said arcuate slot is in said disc, said arcuate slot being positioned so that said central spine can be moved from a substantially horizontal to a substantially vertical position.

9. The portable canvas carrier and easel apparatus of claim 8 wherein both of said cross members are adjusted on said central spine.

10. The portable canvas carrier and easel apparatus of claim 9 wherein said rails on said cross members have channels therein which face each other, each of said rails having two channels therein of different widths so that panels of different thicknesses can be engaged thereby.

* * * * *